US005554054A

United States Patent [19]

Bratina et al.

[11] Patent Number: 5,554,054

[45] Date of Patent: Sep. 10, 1996

[54] TEMPORARY TERMINAL RETENTION FEATURE

[75] Inventors: David J. Bratina, Oberlin; Scott D. Glatfelter, York, both of Pa.

[73] Assignee: The Whitaker Corporation, Wilmington, Del.

[21] Appl. No.: 422,980

[22] Filed: Apr. 17, 1995

[51] Int. Cl.[6] ..... H01R 4/22

[52] U.S. Cl. ..... 439/730

[58] Field of Search ..... 439/730, 750, 439/877, 892

[56] References Cited

U.S. PATENT DOCUMENTS

| | | | |
|---|---|---|---|
| 4,012,106 | 3/1977 | Filson | 439/730 |
| 4,054,350 | 10/1977 | Hardesty | 339/99R |
| 4,195,901 | 4/1980 | Lindlau | 339/198 GA |
| 4,214,361 | 7/1980 | Coldren et al. | 29/863 |
| 4,220,388 | 9/1980 | Dechelette | 339/74 R |
| 4,383,364 | 5/1983 | Casey | 29/863 |
| 4,478,478 | 10/1984 | Durand et al. | 339/263 R |
| 4,842,541 | 6/1989 | Leandris | 439/281 |
| 5,152,700 | 10/1992 | Bogursky et al. | 439/733 |

FOREIGN PATENT DOCUMENTS 0200517 11/1986 European Pat. Off. .

*Primary Examiner*—Gary F. Paumen

[57] ABSTRACT

An electrical connector of the current invention comprises a housing having a cavity to receive a terminal. The cavity having a rear section and a forward section, the rear section having sidewalls with a width therebetween. Temporary stops are disposed along the sidewalls of the cavity. A terminal having a mating portion and a crimping portion, the mating end having a width slightly larger than the width of the rear section. The mating portion is received within the rear portion of the cavity in an interference fit, the temporary stops prevent the terminal from being inserted into the forward section until the crimping portion is crimped to a wire by an assembling machine and the assembling machine inserts the terminal fully into the cavity by forcing the terminal past the temporary stops.

20 Claims, 5 Drawing Sheets

TEMPORARY TERMINAL RETENTION FEATURE

FIELD OF THE INVENTION

This invention relates to an insulated electrical terminal having a temporary retention feature to secure the terminal in position for crimping to a wire.

BACKGROUND OF THE INVENTION

A commonly used type of electrical terminal comprises a receptacle having a web and curled sidewalls extending from the side edges of the web, as is shown in U.S. Pat. No. 4,214,361. Terminals of this type are usually secured to the ends of wires by crimping a U-shaped crimp portion of the terminal onto the wire end. It is frequently necessary, for reasons of safety, to provide insulation in surrounding relationship to the terminal and the end portion of the wire, and the provision of such insulation has been accomplished by several different techniques. One common technique is to provide individual plastic housings which are dimensioned to receive terminals so that the terminals, after being crimped onto wires, can be inserted into the housings in a step subsequent to the crimping step.

Under many circumstances it is highly desirable to crimp the terminal onto the wire in a separate step and follow the procedure described above of inserting the terminal into the housing after crimping. In such situations, the terminals are partially inserted into the housing so that the contact portion of the terminal is contained within the cavity in the housing and the crimp portion of the terminals lies outside of the housing. Stop members or retaining members are provided for preventing the contacts from backing out of the housing, the retaining member being such that the terminal can be moved to its fully inserted condition after crimping, as is shown in U.S. Pat. No. 4,214,361. Another method of securing the terminal within the housing is to have the terminal received in an interference fit between side walls of the housing. The housings with the partially inserted terminals are produced as a continuous strip which can be fed through a crimping apparatus thereby permiting rapid application of the terminal to a wire by the final user and subsequently fully inserting the terminal into the housing.

It would be desirable to provide a retaining feature to prevent the terminal from being fully inserted into the housing before the terminal is crimped onto a wire.

SUMMARY OF THE INVENTION

The electrical connector of the current invention comprises a housing having a cavity to receive a terminal. The cavity having a rear section and a forward section, the rear section having sidewalls with a width therebetween. Temporary stops are disposed along the sidewalls of the cavity. A terminal having a mating portion and a crimping portion, the mating end having a width slightly larger than the width of the rear section of the housing. The mating portion of the terminal is received within the rear portion of the cavity in an interference fit, the temporary stops prevent the terminal from being inserted into the mating end of the housing until the crimping portion is crimped to a wire by an assembling machine and the assembling machine inserts the terminal fully into the cavity by forcing the terminal past the temporary stops.

BRIEF DESCRIPTION OF THE DRAWINGS

Embodiments of the invention will be described by way of example with reference to the accompanying drawings, in which.

DETAILED DESCRIPTION OF THE INVENTION

Figure 1:
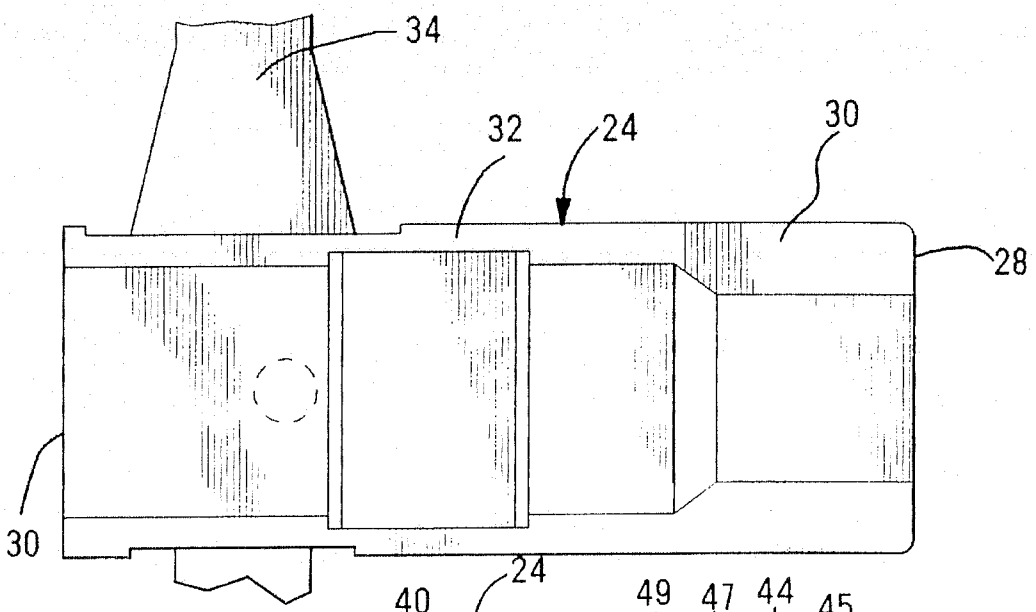
FIG. 1 is a top view of a housing showing the carrier strip.

As shown in FIG. 1, the housing 24 is formed along a carrier strip 34 to which other housings are attached, as is shown in U.S. Pat. No. 4,214,361 and incorporated herein by reference. This arrangement of the housings 24 allows the housings to be continuously fed into a crimping/assembling machine.

Figure 2:
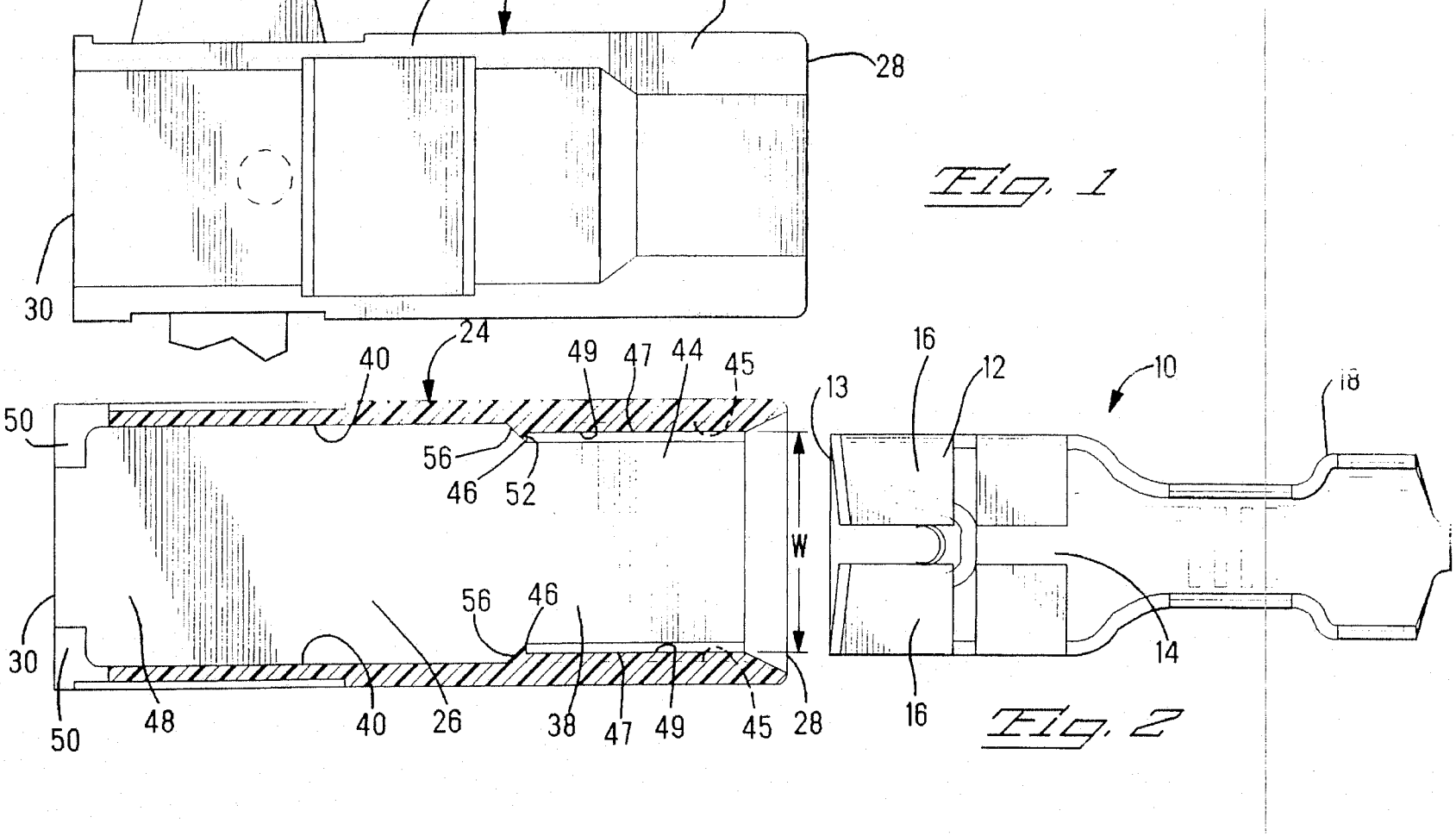
FIG. 2 is a cross sectional view of the housing and a terminal.
Figure 3:
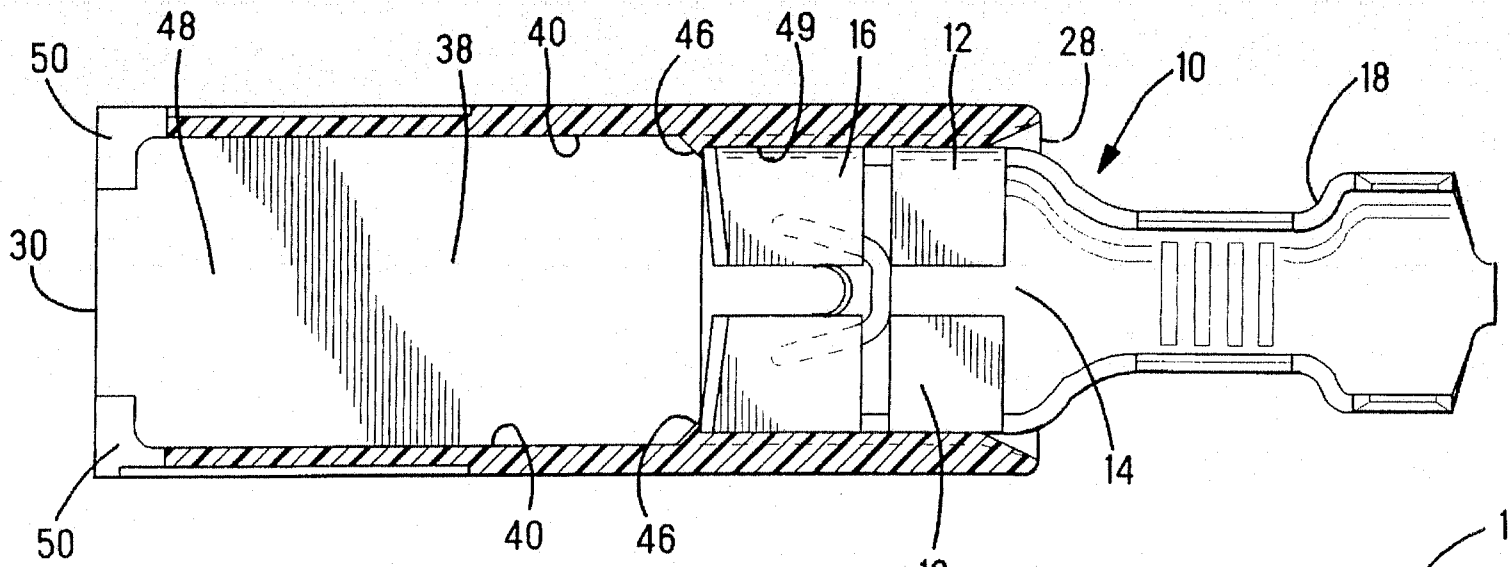
FIG. 3 is a cross sectional view similar to FIG. 2 of the housing and the terminal in a first position.

As shown in FIGS. 2 and 3, an electrical terminal 10 has a contact end 12 and a crimp end 18. The terminal 10 has a front end 13, a web 14, and curved over sidewalls 16. The terminal 10 is of a common type which is dimensioned to be mated with a complementary mating tab. The crimp portion 18 is a U-shaped section which is designed to be crimped on a wire 19, see FIG. 4.

Figure 4:
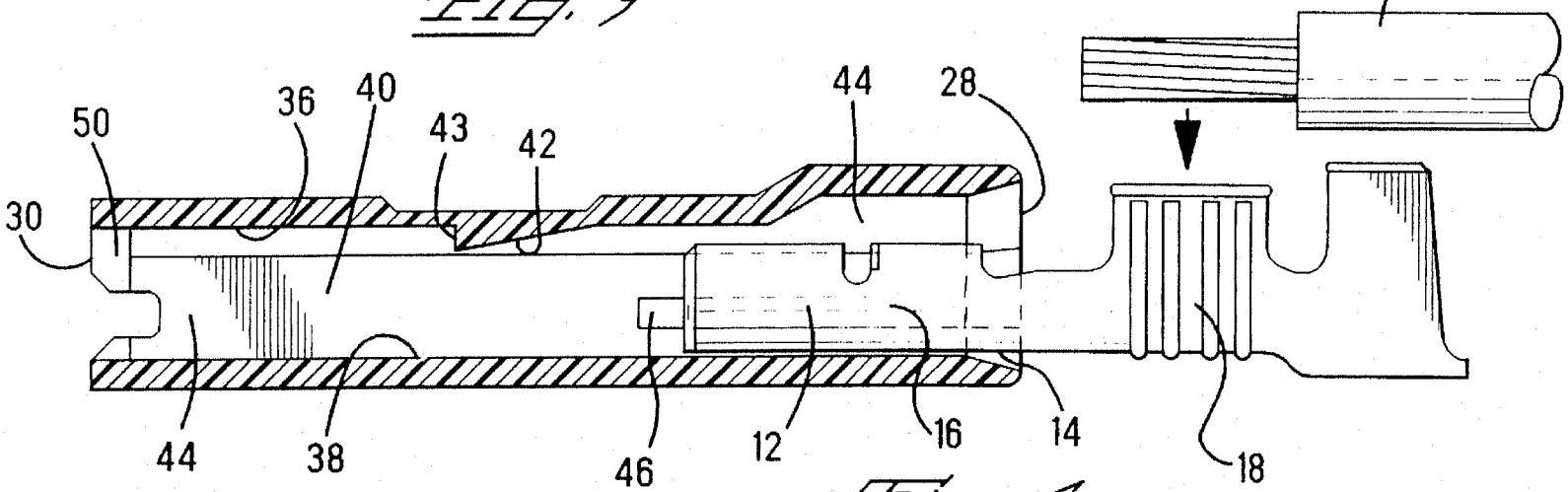
FIG. 4 is a side cross sectional view of the housing and the terminal in the first position.
Figure 9:
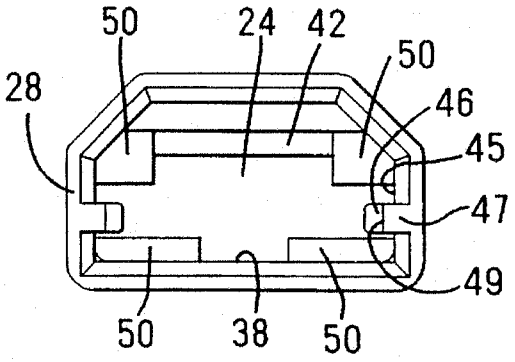
FIG. 9 is a rear view of the housing.

The insulating housing 24 has outer surfaces 32 and a cavity 26 which extends from a back end 28 to a mating end 30, see FIG. 1. The terminal 10 is received into the housing from the back end 28. The cavity 26 has a top wall 36, a bottom wall 38, and sidewalls 40, see FIG. 4. The cavity further has a rear portion 44 which is towards the back end 28 of the cavity. As best shown in FIGS. 2 and 4, the cavity 26 also has a forward portion 48 which is towards the mating end 30 of the housing 24. The top wall 36 has a latching surface 42 (FIG. 4) which is a ramped surface extending downwardly from the top wall 36. The latching surface 42 further has a flat surface 43 which is directed towards the mating end 30 of the housing. The forward portion 48 of the cavity 26 includes secondary stops 50. The secondary stops 50 are flush with the mating end 30 of the housing. The rear portion 44 has side walls 45 with protrusions 47 extending along each side wall, see FIGS. 2 and 9. The protrusions have inner sidewalls 49 with a width W between the sidewalls 49. Stops 46 are disposed along the sidewalls 40 at the forward end of the protrusions 47. The stops 46 are intermediate between the rearward portion 44 and the forward portion 48 and intermediate between the top wall 36 and the bottom wall 38. The width between the sidewalls of the forward portion 48 is greater than the width W of the rear portion 44. The stops 46 have a flat surface 52 which is directed toward the rearward end 28. The stops 46 also have a forward ramped surface 56 which is directed towards the mating end 30 of the housing.

FIGS. 3 and 4 shows the terminal inserted into the housing 24 in a first position. The width of the terminal 10 is slightly larger than the width W of the rear portion 44. Therefore, the terminal 10 is received within the rear portion 44 in an interference fit. The stops 46 prevent the terminal 10 from being inserted further into the housing 24, thereby securing the terminal 10 in the housing 24. The first position has the contact end 12 received within the housing 24 and the crimping end 18 of the terminal is outside of the housing 24 to allow the terminal to be crimped to a wire 19. The front end 13 of the terminal 10 is received against the flat surface 52 of the stops 46. The housing 24 is connected along a carrier strip 34 with additional housings 24, as is illustrated in FIG. 1, all the housings having terminals in the first position.

Figure 5:
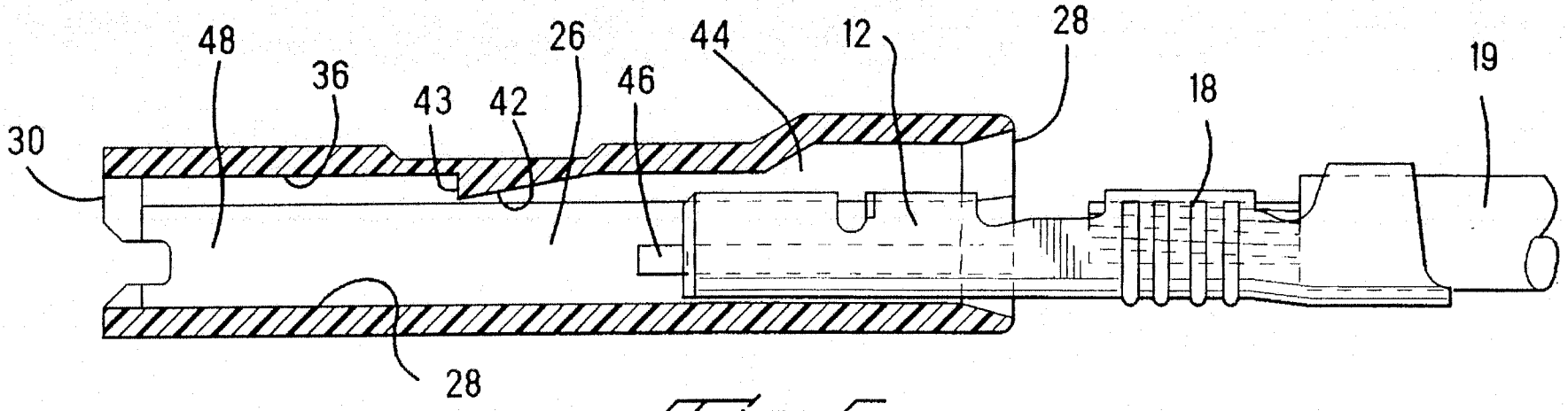
FIG. 5 is a view similar to FIG. 4 showing the terminal crimped to a wire.

The carrier strip of housings 24 having the terminals 10 inserted in the first position is fed into an assembling machine. In a first step, the assembling machine crimps the terminal 10 to the wire 19, see FIG. 5. In a second step, the terminated terminal 10 is inserted into a second position within the housing 24.

Figure 6:
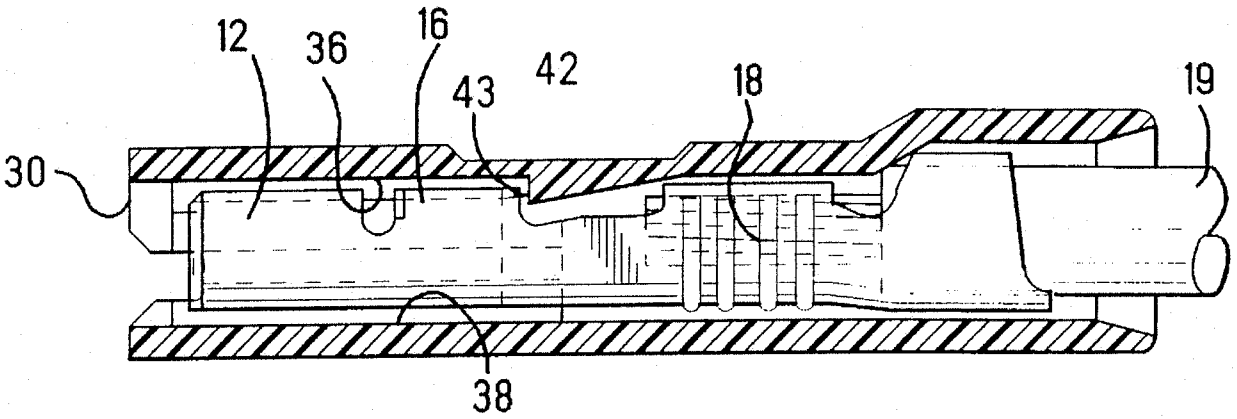
FIG. 6 is a side cross sectional view showing the terminal fully inserted into the housing.
Figure 7:
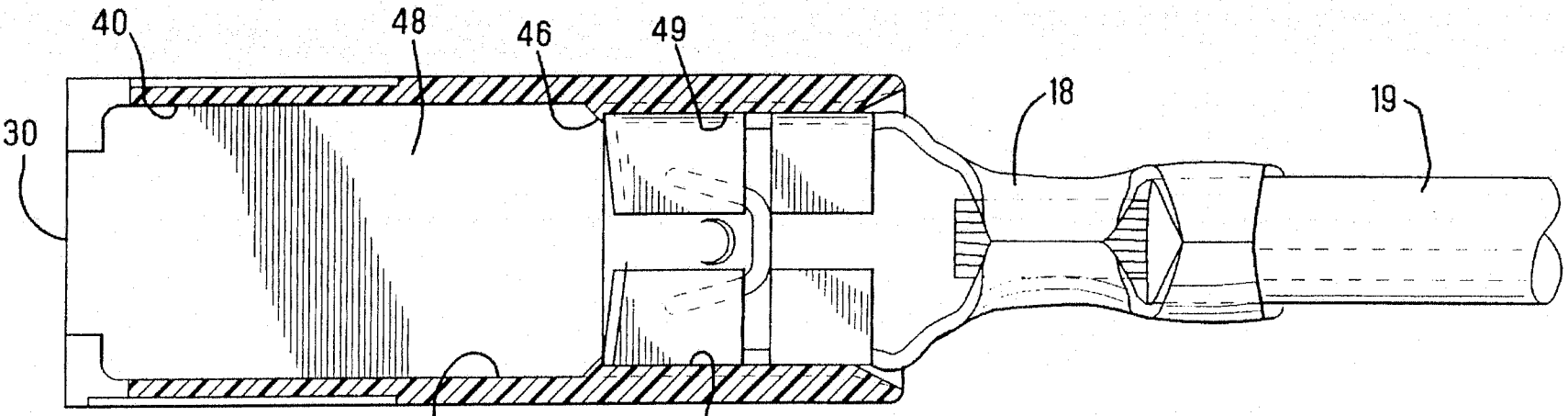
FIG. 7 is a cross sectional view similar to FIG. 3 showing the terminal crimped to the wire.
Figure 8:
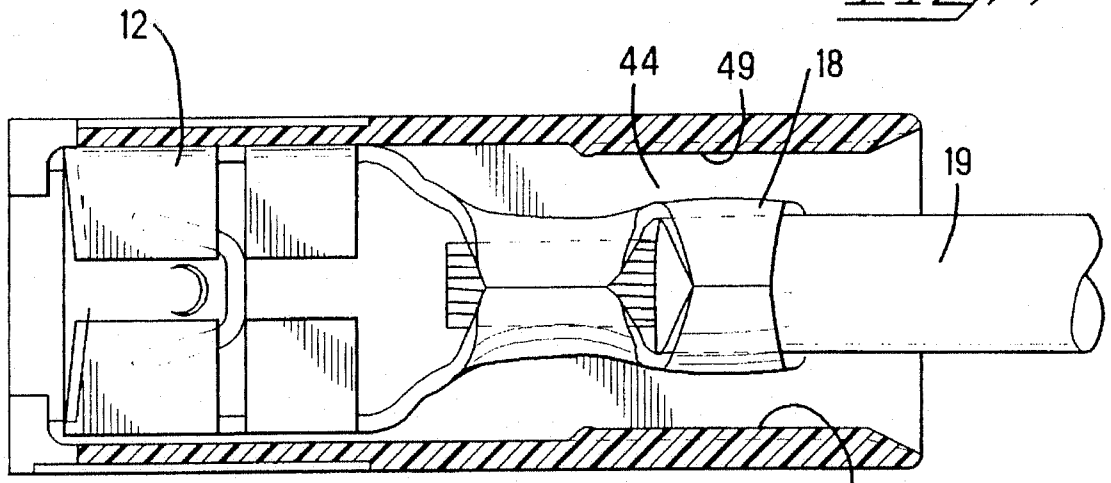
FIG. 8 is a cross sectional view showing the terminal in the fully inserted position.

The second position of the terminal 10 within the housing 24 is achieved when terminal 10 is pushed past the stops 46 into the forward portion 48, see FIGS. 6 and 8. The stops 46 are wiped away or crushed against the sidewalls of the housing by the force applied by the assembling machine to the terminals 10. The stops 46 initially prevent the terminal from being fully inserted into the housing, but the assembling machine provides enough force to push the terminal past the stops and into the second position. In the second position within the housing 24, the contact end 12 is held in the forward portion 48 and the crimped portion 18 along with the wire 19 is received in the rear portion 44. The terminal is secured in the second position by the secondary stops 50 along the mating end 30 which prevent the terminal from being pushed through the mating end 30 of the housing 24. The flat surface 43 of the latching surface 42 engages back ends of the curved over sidewalls 16 of the terminal 10 to prevent the terminal from backing out of the housing. The forward portion of the cavity 26 is wider than the rear portion 44 so when the contact end 12 is received in the forward portion 48, the terminal is no longer in an interference fit with the housing. The terminal 10 is free to move slightly within the cavity so that it can be aligned with a mating tab, not shown, however, it is prevented from being removed from the cavity 26 by the forward stops 50 and the flat surface 43 of the latching surface 42.

Figure 10:
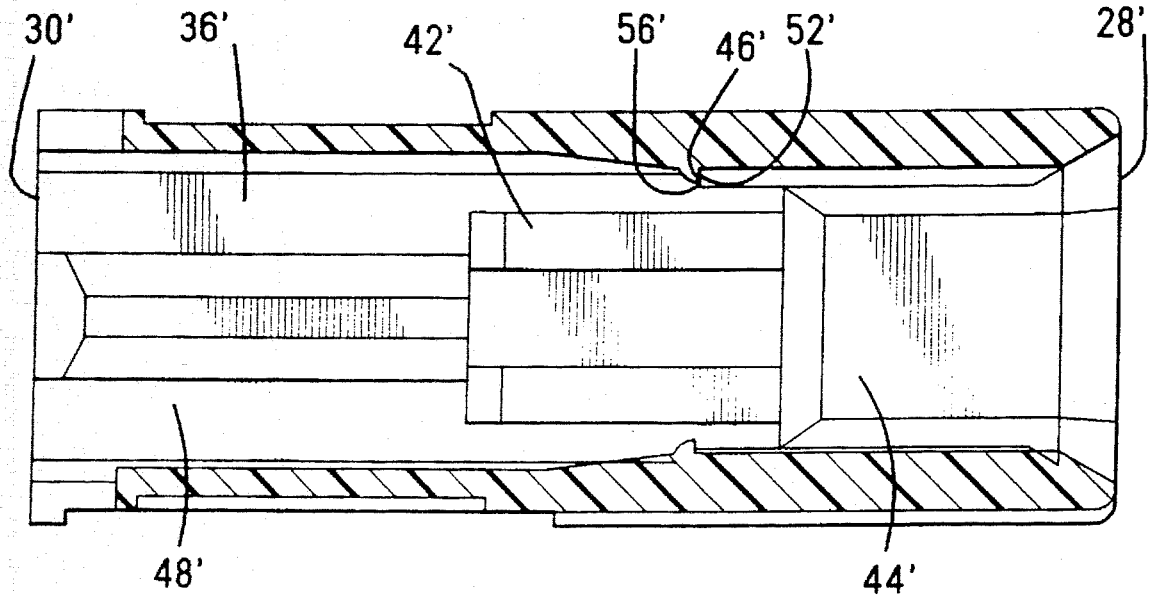
FIG. 10 is cross sectional view showing an alternative embodiment of the invention.
Figure 11:
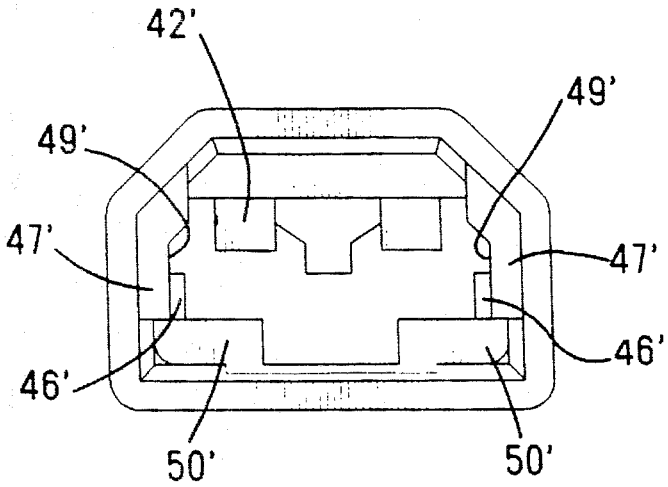
FIG. 11 is a rear view of the housing of the alternative embodiment.

An alternative embodiment is shown in FIGS. 10 and 11. The stops 46' have a flat surface 52' which is directed toward the back end 28' and have a forward rounded surface 56' which is directed toward the mating end 30'. In the alternative embodiment the terminal 10 is also received within the rear portion 44' in an interference fit to hold the terminal within the housing. The stop 46' prevents the terminals from being pushed forward within the housing prior to crimping to the wire. During assembly, the terminal is first crimped to the wire and then forced beyond the stop 46' into the forward portion 48' of the housing. The terminal 10 is secured in the forward portion 48' by the ramped latching surface 42' which engages the back end of the curved over side walls 16 of the terminal 10. The terminal is prevented from being pushed forward within the housing by secondary stops 50' along the mating end 30' of the housing.

The stops have been shown in two embodiments, however it is understood that the stops could be formed in any variety of shapes that would be capable of retaining the terminal in the first position.

The terminal has been shown as being received in an interference fit between protrusions on the side walls of the cavity. It is understood that the terminal can be of varying configurations and can be retained within the housing by some other form of interference fit between other features of the housing, or alternatively, by some temporary latching feature.

The electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. An electrical connector, comprising:

a housing having a cavity with a rear section and a forward section towards a mating end of the housing, the rear section having sidewalls with a width therebetween;

a temporary stop disposed along the side wall in the rear section; and a terminal having a mating portion and a crimping portion, the mating portion having a width slightly larger than the width of the rear portion;

whereby when the mating portion is temporarily secured within the rear portion of the cavity in an interference fit, the temporary stop prevents the terminal from being inserted in the mating end until the crimping portion is crimped to a wire by an assembling machine and the assembling machine inserts the terminal fully into the cavity by forcing the terminal past the temporary stop thereby destroying the temporary stop.

2. The electrical connector of claim 1, wherein the stop is disposed intermediate between the rear section and the forward section.

3. The electrical connector of claim 2, wherein the cavity has a top wall and a bottom wall, the temporary stop being intermediate therebetween.

4. The electrical connector of claim 3, wherein protrusions extend along the rear section, the sidewalls being disposed along the protrusions with the width therebetween.

5. The electrical connector of claim 4, wherein the forward section has a width which is wider than the width between the sidewalls in the rear section.

6. The electrical connector of claim 1, wherein the mating portion of the terminal has a web with curved over sidewalls for engaging a matable tab contact.

7. The electrical connector of claim 1, wherein the cavity further includes a latching surface along a top wall and stops along a mating end to secure the terminal within the cavity after crimping of the terminal to the wire and full insertion of the terminal within the cavity.

8. The electrical connector of claim 1, wherein there are two of said temporary stops, one along each of the sidewalls of the cavity.

9. The electrical connector of claim 8, wherein the temporary stops have flat surfaces directed toward the rear section of the cavity, a front end of the terminal being received against the flat surface, the temporary stops further having a curved section directed toward the forward section of the cavity.

10. The electrical connector of claim 8, wherein the temporary stops have flat surfaces directed toward the rear section of the cavity, a front end of the terminal being received against the flat surface, the temporary stops further having a ramped section directed toward the forward section of the cavity.

11. The electrical connector, comprising:

a housing having a cavity with a rear section and a forward section towards a mating end of the housing, the rear section having sidewalls;

a temporary stop disposed along the side wall in the rear section; and a terminal which is first received in the rear section and prevented from being moved into the forward section by the temporary stop;

whereby when the terminal is inserted into the forward section by an assembling machine the terminal is forced past the temporary stop thereby destroying the temporary stop.

12. The electrical connector of claim 11, wherein the stop is disposed intermediate between the rear section and the forward section.

13. The electrical connector of claim 12, wherein the cavity has a top wall and a bottom wall, the temporary stop being intermediate therebetween.

14. The electrical connector of claim 13, wherein protrusions extend along the rear section, the sidewalls being disposed along the protrusions with the width therebetween.

15. The electrical connector of claim 14, wherein the forward section has a width which is wider than the width between the sidewalls in the rear section.

16. The electrical connector of claim 11, wherein the mating portion of the terminal has a web with curved over sidewalls for engaging a matable tab contact.

17. The electrical connector of claim 11, wherein the cavity further includes a latching surface along a top wall and stops along a mating end to secure the terminal within the cavity after crimping of the terminal to the wire and full insertion of the terminal within the cavity.

18. The electrical connector of claim 11, wherein there are two of said temporary stops, one along each of the sidewalls of the cavity.

19. The electrical connector of claim 18, wherein the temporary stops have flat surfaces directed toward the rear section of the cavity, a front end of the terminal being received against the flat surface, the temporary stops further having a curved section directed toward the forward section of the cavity.

20. The electrical connector of claim 18, wherein the temporary stops have flat surfaces directed toward the rear section of the cavity, a front end of the terminal being received against the flat surface, the temporary stops further having a ramped section directed toward the forward section of the cavity.

* * * * *